US006417812B1

(12) United States Patent
Tsai

(10) Patent No.: US 6,417,812 B1
(45) Date of Patent: Jul. 9, 2002

(54) ELECTRICAL CONNECTOR INCORPORATING ANTENNA

(75) Inventor: Szu-Nan Tsai, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/670,057

(22) Filed: Sep. 25, 2000

(30) Foreign Application Priority Data

May 16, 2000 (TW) ..... 089109380

(51) Int. Cl.[7] ..... H01Q 21/00
(52) U.S. Cl. ..... 343/725; 343/895; 439/131
(58) Field of Search ..... 343/895, 715, 343/725; 385/90; 439/131, 344, 607, 609

(56) References Cited

U.S. PATENT DOCUMENTS 5,168,280 A * 12/1992 Blaese ..... 343/715
5,278,570 A * 1/1994 Jaramillo et al. ..... 343/702
5,340,333 A * 8/1994 Schroth ..... 439/607
5,934,917 A * 8/1999 Haut ..... 439/131
6,023,245 A * 2/2000 Gomez et al. ..... 343/725

* cited by examiner

*Primary Examiner*—Don Wong
*Assistant Examiner*—Jimmy T. Vu
(74) *Attorney, Agent, or Firm*—Wei Te Chung

(57) ABSTRACT

An RJ-45 receptacle connector (3, 6) supports an antenna assembly (2, 7) therein. The antenna assembly comprises a coaxial cable portion (19, 90), an antenna portion (14, 8) electrically connected to the cable portion and a carrier (12, 70) received in the receptacle connector and supporting the antenna portion. The antenna portion is a helical monopole and works in a bandwidth range of 2.357~2.570 GHz, wherein transmission with a Voltage Standing Wave Ratio (VSWR) in the range of 1~2 is achieved.

18 Claims, 7 Drawing Sheets

ELECTRICAL CONNECTOR INCORPORATING ANTENNA

BACKGROUND OF THE INVENTION

1. Field of the Invention

The present invention relates to an electrical connector, and particularly to an electrical connector incorporating an antenna therein.

2. Description of the Related Art

Conventionally, wires are used to connect computers into a Local Area Network (LAN). Each wire is connected to a computer using an RJ-45 plug connector at one end of the wire engaging with an RJ-45 receptacle connector mounted in the computer. Routing of the wires presents a variety of problems. Furthermore, computers nowadays connect with corresponding peripherals by means of wires and cables, which further adds to routing problems. Wireless technology may be a solution for the above-mentioned problems caused by cables and wires. Wireless communication uses antennas in place of wires and cables to communicate between devices.

When utilizing wireless LAN technology, existing RJ-45 receptacle connectors now used in computers (many of which may already be integrated with other types of connectors) are rendered useless. Furthermore, adding an antenna to a current-day computer would consume additional space inside the computer. This would run counter to the trend toward compact design at best, and may even be impossible at worst, since the space available in a computer is quite limited. Therefore, a means for efficiently utilizing the space inside an RJ-45 receptacle connector to incorporate an antenna therein is desired.

SUMMARY OF THE INVENTION

The object of the present invention is to provide a compact connector which comprises an antenna therein for use in making wireless connections.

The present invention includes a connector and an antenna assembly. The connector is an RJ-45 receptacle connector. The antenna assembly comprises an antenna portion and a cable portion electrically connected with the antenna portion. The antenna assembly is supported by the connector.

Other objects, advantages and novel features of the invention will become more apparent from the following detailed description of the present embodiment when taken in conjunction with the accompanying drawings.

DETAILED DESCRIPTION OF THE INVENTION

Figure 1:
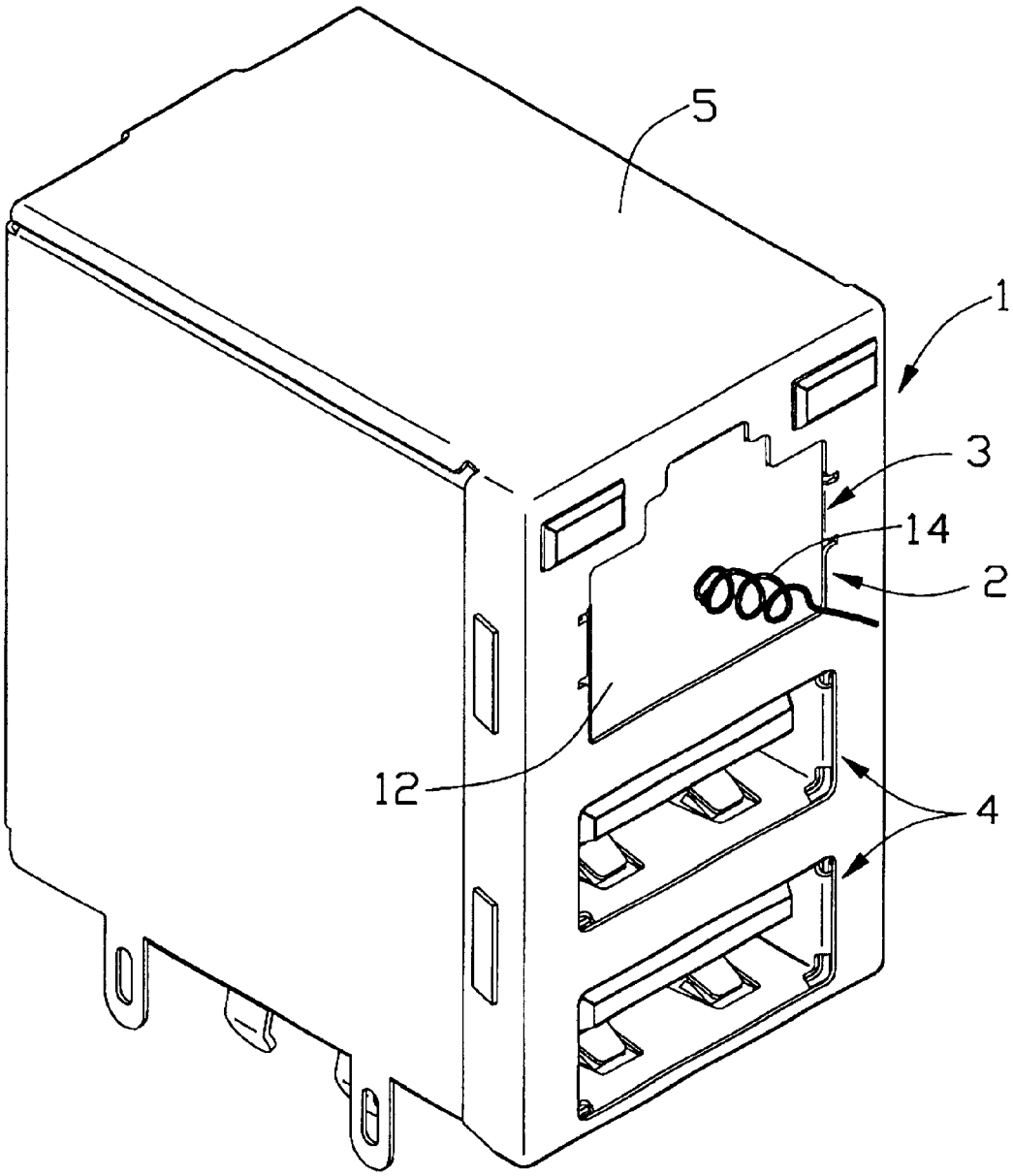
FIG. 1 is a perspective view of an electrical connector incorporating an antenna assembly therein in accordance with a first embodiment of the present invention.
Figure 2:
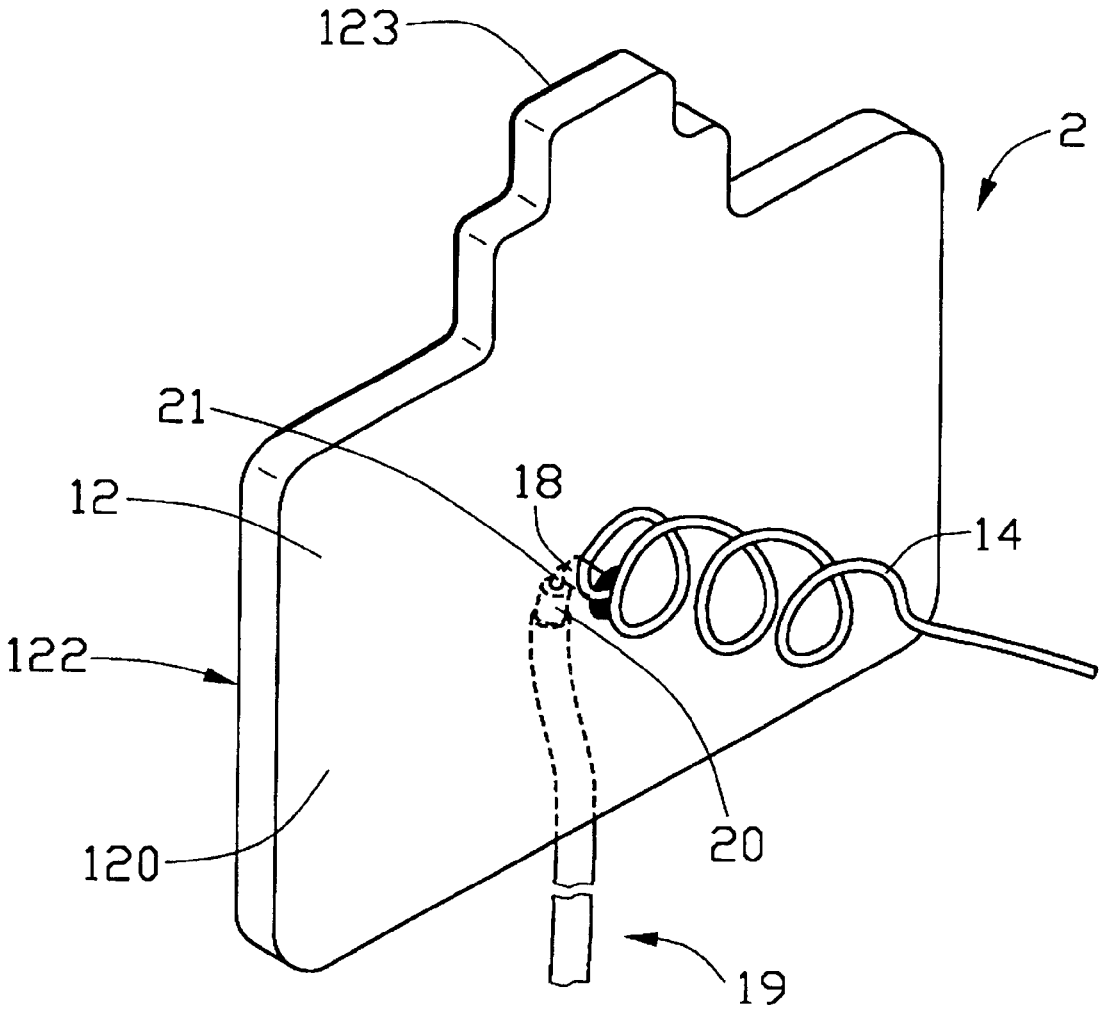
FIG. 2 is a perspective view of the antenna assembly of FIG. 1.

Referring to FIGS. 1 and 2, a first embodiment of the present invention includes an electrical connector assembly 1 comprising an RJ-45 receptacle connector 3, an antenna assembly 2, a pair of stacking electrical connectors 4 and a shield 5. The antenna assembly 2 is mounted within a front surface of the RJ-45 receptacle connector 3. In the embodiment shown, the two stacking electrical connectors 4 are Universal Serial Bus connectors.

The antenna assembly 2 comprises a board portion 12, a helical monopole antenna portion 14 and a coaxial cable portion 19. The board portion 12 is made from a dielectric substrate and has a first side face 120 and a second side face 122 opposite to the first side face 120. A conductive metal coating 123 covers the second side face 122. An outer profile of the board portion 12 is configured corresponding to a profile of an inner receptacle space of the connector 3 and is firmly fitted within the connector 3. A through hole 18 is defined in substantially a center of the board portion 12 and extends through the first side face 120 and the metal coating 123.

The antenna portion 14 has an end extending into the hole 18, while the remainder of the antenna portion 14 projects forwardly from the first side face 120 of the board portion 12.

The cable portion 19 has a core conductor 21 extending into the hole 18 and electrically connecting with the end of the antenna portion 14 in the hole 18 by soldering. The cable portion 19 further has a shielding/grounding braid 20 surrounding the core conductor 21. A layer of dielectric insulation (not labeled) separates the core conductor 21 from the braid 20 along the length of the cable portion 19. The braid 20 is electrically and mechanically connected to the metal coating 123 by soldering. The antenna portion 14 and the cable portion 19 are thus mechanically supported by the board portion 12, while simultaneously the metal coating 123 of the board portion 12 connects with the shield 5 to provide grounding/shielding. Thus, the antenna assembly 2 can function to transmit signals to/from an RF signal processing circuit (not shown) connected to an opposite end of the cable portion 19. The board portion 12 can slide rearwardly into the receptacle space of the RJ-45 receptacle connector 3. Thus, when the antenna portion is not used, the board portion 12 can be pushed inwardly to hold the antenna portion 14 in a retracted position within the RJ-45 receptacle connector 3.

Alternative configurations of stacked connectors may also be created. Only one embodiment, which includes two USB connectors, has been described above. For example, the RJ-45 receptacle connector 3 and multiple stacking connectors 4 can be stacked one above the other.

In a second embodiment of the present invention (see FIG. 3), the RJ-45 receptacle connector 3 is arranged side by side with only one stacking connector 4, and a shield 5' covers both the connector 3 and the stacking connector 4. In this embodiment, the antenna assembly 2 has a construction similar to that of the first embodiment; thus, a detailed description thereof is omitted herefrom.

Figure 4:
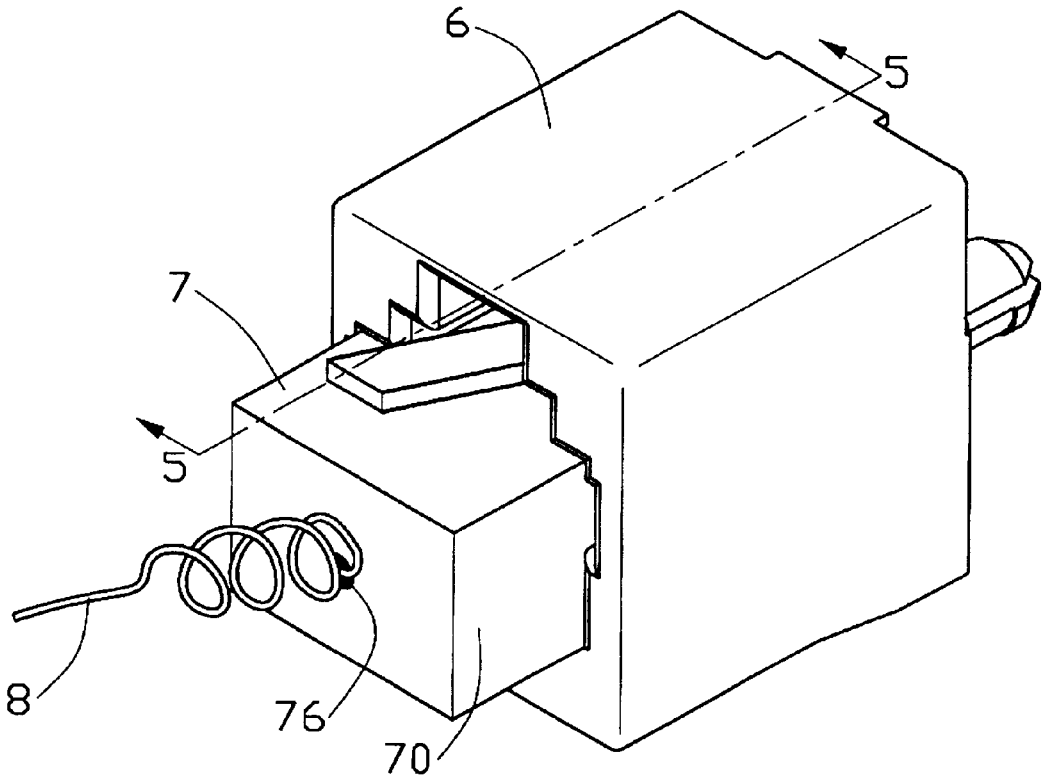
FIG. 4 is a view similar to FIG. 1, showing a third embodiment of the present invention.
Figure 5:
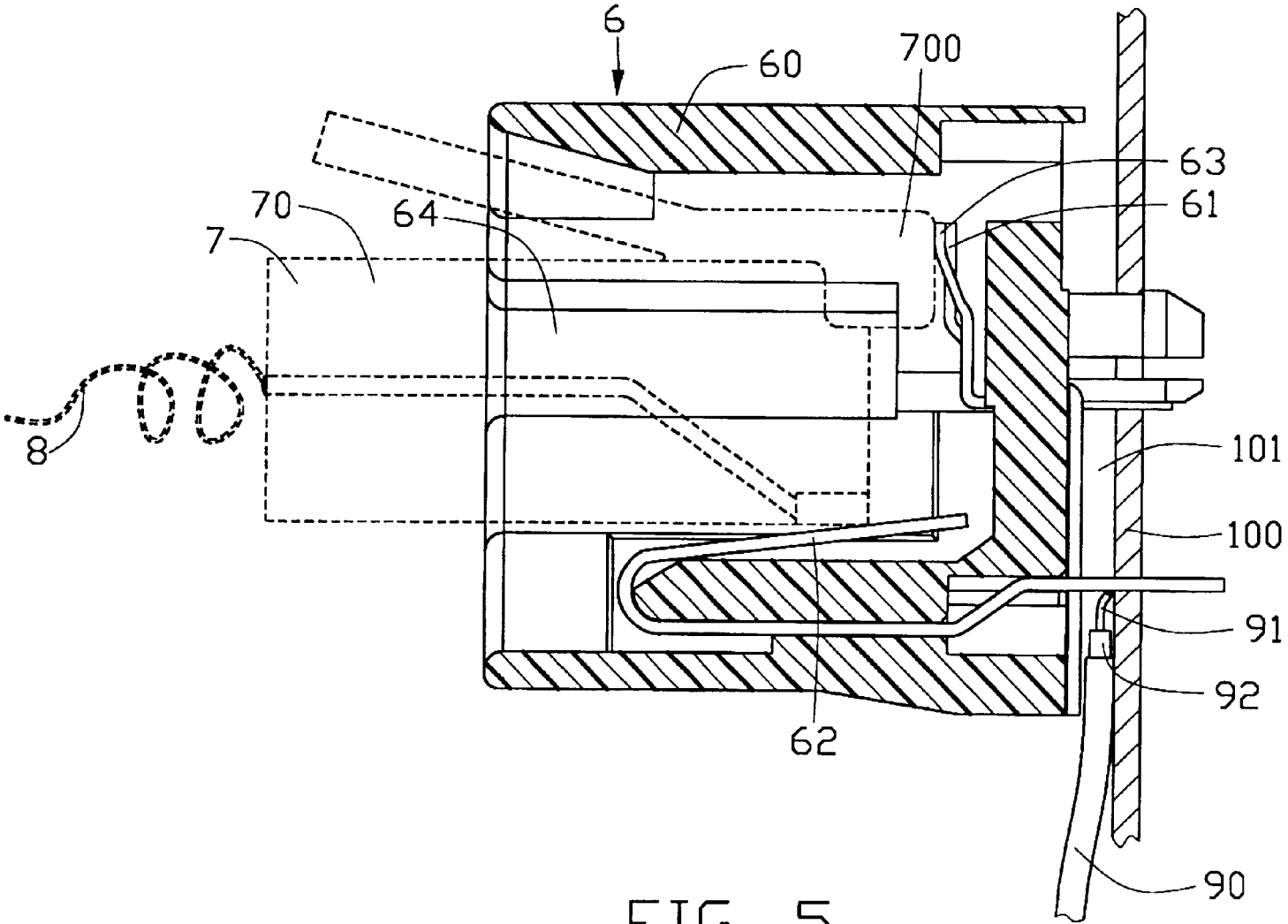
FIG. 5 is a cross-sectional view taken from line 5—5 of FIG. 4 wherein an antenna carrier is shown in dotted lines.
Figure 6:
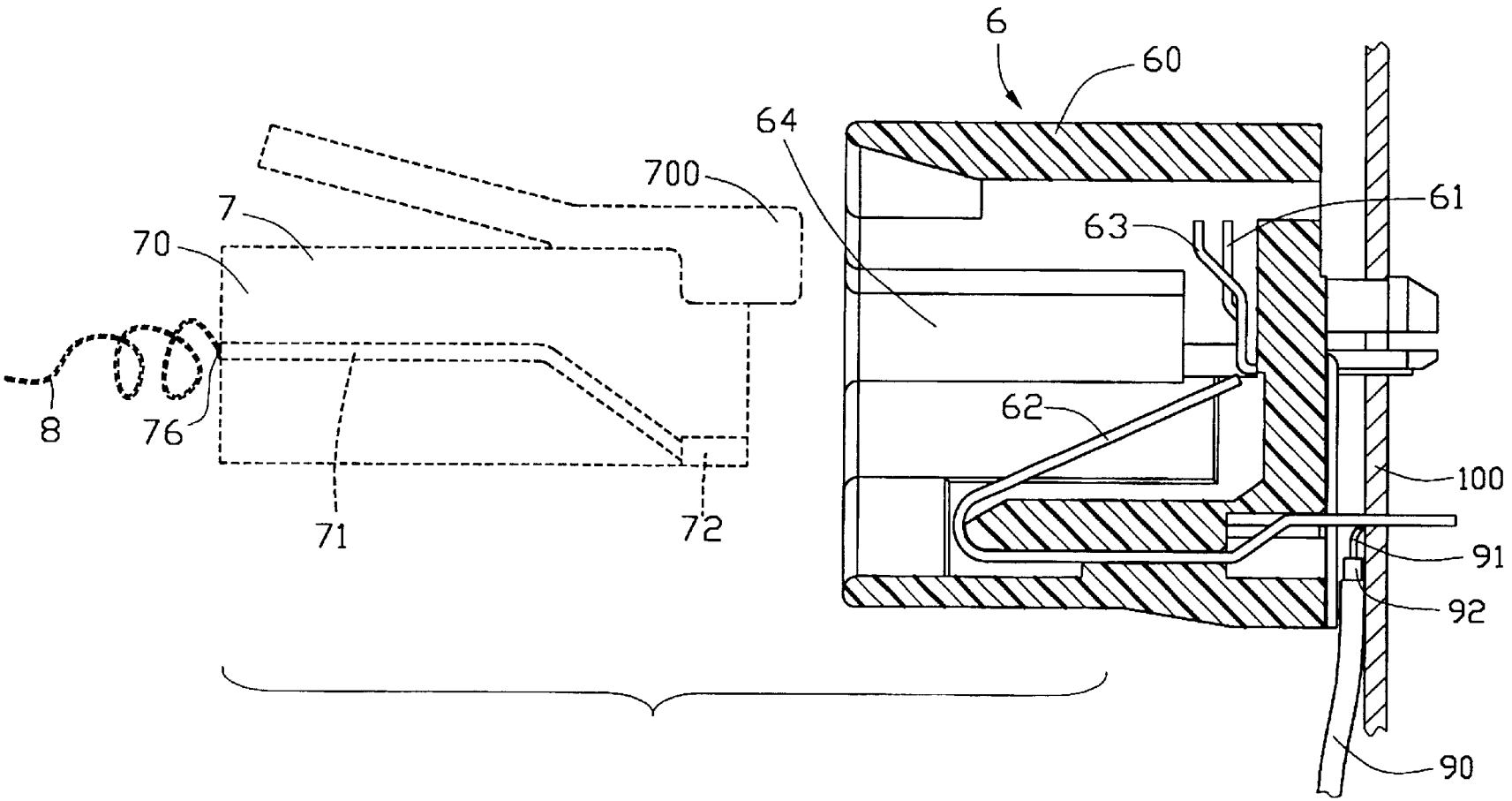
FIG. 6 is a view similar to FIG. 5, but having the antenna carrier disengaged from the connector.

Referring now to FIGS. 4–6, a third embodiment of the present invention comprises an RJ-45 receptacle connector 6 and an antenna assembly 7. The antenna assembly comprises a dielectric carrier 70 having a configuration substantially similar to that of a dielectric housing of an RJ-45 plug connector. The carrier 70 may be optionally shielded by a metallic shield, if desired. A conductor 71 extends through the carrier 70 to connect with a contact 72 at a rear, lower portion of the carrier 70. A helical antenna portion 8 protrudes from a front side of the carrier. The antenna portion 8 has a rear end 76 soldered to a front end of the conductor 71. The carrier 70 comprises an abutting protrusion 700 protruding rearwardly from the rear end of the carrier 70. A coaxial cable portion 90 is at a rear of the receptacle connector 6, as described below.

The connector 6 comprises an insulative housing 60, a first switching contact 61, a second switching contact 63 and a plurality of electrical contacts 62. The insulative housing 60 defines a receiving cavity 64 therein, into which the first and second switching contacts 61, 63 and the electrical contacts 62 extend. The connector 6 is mounted to a circuit board 100, and a space (not labeled) is defined between a rear of the connector 6 and the circuit board 100 to let the cable portion 90 extend therthough.

The cable portion 90 comprises a core conductor 91 electrically connected to one of the electrical contacts 62 of the connector 6, and a shielding/grounding braid 92 connected to a grounding circuit of the circuit board 100. A layer of dielectric insulation (not shown) separates the core conductor 91 from the braid 92 along the length of the cable portion 90.

When the carrier 70 with the antenna portion 8 is inserted into the receptacle connector 6, the abutting protrusion 700 abuts against the second switching contact 63 and urges the second switching contact 63 to engage with the first switching contact 61, thereby switching on a wireless processing circuit (not shown). Alternatively, the first and second switching contacts 61, 63 may be arranged to disengage from each other when the second switching contact 63 is pressed by the abutting protrusion 700 in different designs. The contact 72 of the carrier 70 connected with the antenna portion 8 is engaged with a corresponding electrical contact 62 to transmit information between the antenna portion 8 and the conductor 91 of the cable portion 90.

Figure 3:
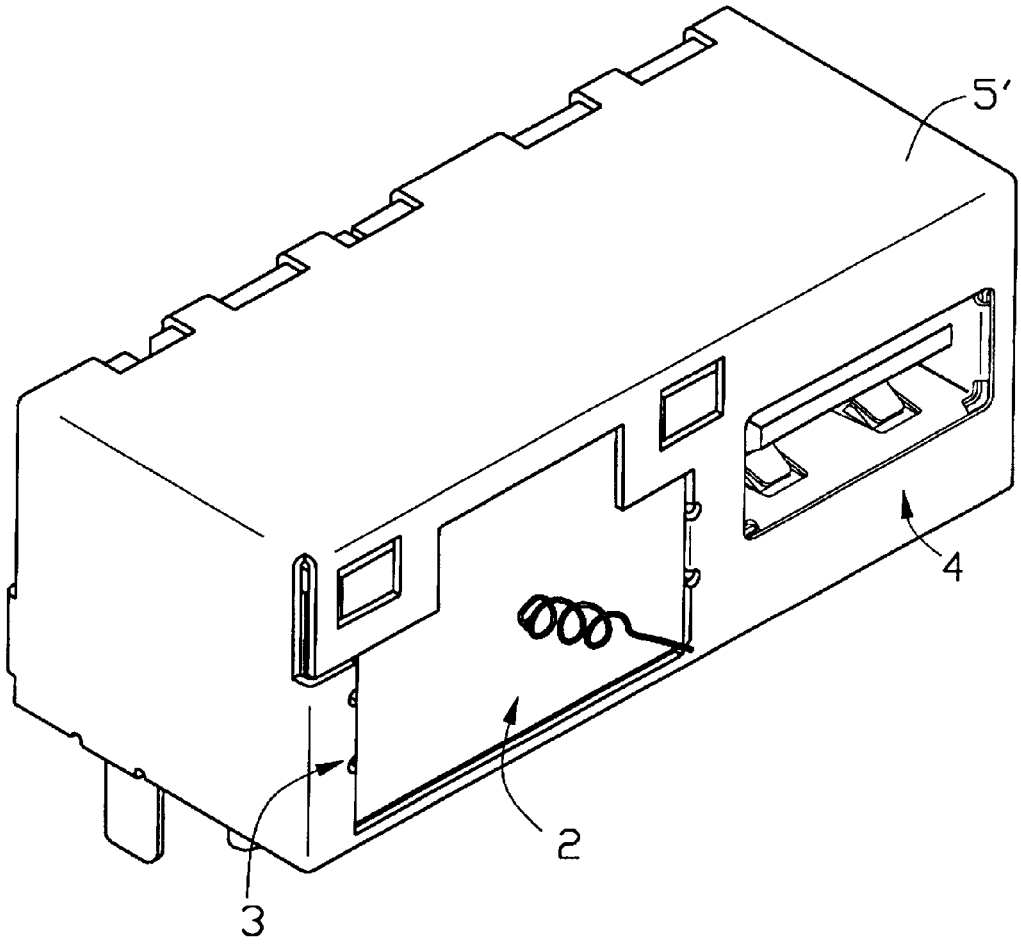
FIG. 3 is a view similar to FIG. 1, showing a second embodiment of the present invention.

A prototype of the antenna assembly 2 shown in FIGS. 1—3 was tested and found to function in a bandwidth range of 2.327~2.570 GHz with a Voltage Standing Wave Ratio (VSWR) in the range of 1~2, which is at a bandwidth range in the license-free Industry, Science and Medical bandwidth.

Figure 7:
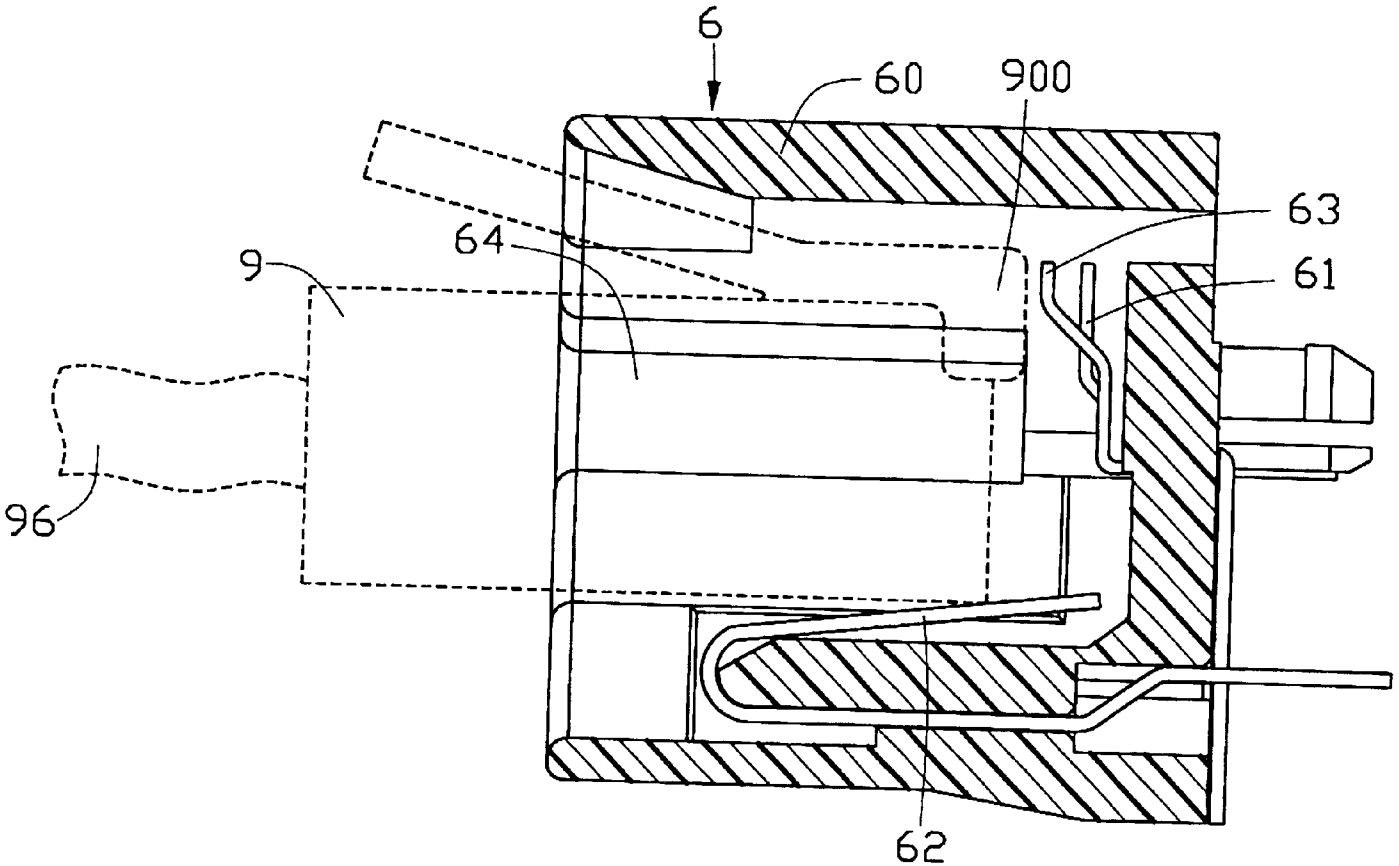
FIG. 7 is a view similar to FIG. 5, but showing a conventional plug inserted into the connector.

As can be seen from FIG. 7, the receptacle connector 6 can also be used as a conventional RJ-45 receptacle connector, receiving a conventional RJ-45 plug connector 9 when wireless capability is not required.

The plug connector 9 is similar in external configuration to the antenna assembly 7, but the contacts (not shown) inside the plug connector 9 connect to conductors (not shown) of a wire 96 disposed at a front end of the plug connector 9. Also, an abutting protrusion 900 formed on a top surface of the plug connector 9 protrudes rearwardly a shorter distance from a rear of the connector 9 than the abutting protrusion 700 protrudes rearwardly from the carrier 70.

When the plug connector 9 is inserted into the receiving cavity 64 of the receptacle connector 6, the abutting protrusion 900 does not abut the second switch contact 63 and the wireless processing circuit (not shown) is not switched on. The contacts (not shown) inside the plug connector 9 respectively engage with the electrical contacts 62, thereby transmitting information carried by conductors (not shown) of the wire 96 to the printed circuit board (not shown) in conventional manner.

The antenna assemblies 2, 7 combined with the electrical connectors 3, 6, thus achieve a wireless function without requiring a separate additional space for an antenna portion 14, 8. This saves space, simplifies assembly, and reduces costs. Additionally, an otherwise surplus connector can be put to use.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical apparatus comprising:

an insulative receptacle connector housing defining an internal cavity therein, said internal cavity being configured to receive an RJ plug connector housing therein;

a carrier fitted in the cavity and defining an outer profile generally similar to that of said internal cavity;

an antenna portion fixed to the carrier; and a coaxial cable having a core conductor electrically connected to the antenna portion and a braid surrounding and shielding the core conductor.

2. The electrical apparatus as claimed in claim 1, wherein the receptacle connector housing is an RJ-45 receptacle connector housing and the carrier has a board-like configuration, the carrier having a first side face facing opposite to the cavity and a second side face facing toward the cavity, a metal coating covering the second side face, the braid of the coaxial cable being electrically connected to the metal coating.

3. The electrical apparatus as claimed in claim 2, wherein the antenna portion projects from the first side face of the carrier and has an end extending into a hole in the carrier and electrically connected to the core conductor of the coaxial cable.

4. The electrical apparatus as claimed in claim 1, wherein the insulative receptacle connector housing is an RJ-45 receptacle connector housing, a conductive terminal being fixed to the carrier, a conductor being received in the carrier, the antenna portion being electrically connected to the conductor in the carrier which in turn electrically connects with the terminal, the core conductor of the coaxial cable electrically connecting with the terminal.

5. The electrical apparatus as claimed in claim 4, wherein the receptacle connector housing is mounted to a printed circuit board, and the braid of the coaxial cable is electrically connected to a grounding circuit of the printed circuit board.

6. The electrical apparatus as claimed in claim 1, wherein the carrier can be pushed inwardly to hold the antenna portion in a retracted position within the cavity where the antenna portion does not project out of the cavity, when the antenna portion is not used.

7. The electrical apparatus as claimed in claim 1, wherein the carrier includes metal coating respectively connected to the braid of the coaxial cable and a metal shield of the receptacle connector which encloses said receptacle connector.

8. An electrical apparatus comprising:

a receptacle connector defining a cavity therein;

a first set of contacts and a second set of contacts respectively disposed in said cavity, said first set of contacts being used for switching circuits while said second set of contacts being used for signal transmission; and a cable positioned around a rear portion of the receptacle connector and electrically connected to said second set of contacts.

9. The apparatus as claimed in claim 8, further including an antenna assembly defining a housing configured to comply with the cavity with an antenna portion extending forwardly and outwardly and a third set of contacts extending rearwardly and inwardly and electrically connected to the antenna portion, wherein when said antenna assembly is assembled to the receptacle connector in said cavity, the first set of contacts will switch on wireless processing circuits whereby signals caught by the antenna portion transmitted via the third set of contacts and the second set of contacts to the cable will activate said wireless processing circuits.

10. The apparatus as claimed in claim 8, further including a plug connector with a wire extending forwardly and outwardly and a fourth set of contacts extending rearwardly and inwardly and electrically connected to the wire, wherein when said plug connector is assembled to the receptacle connector in said cavity, the first set of contacts will not switch on wireless processing circuits whereby signal from the wire will be transmitted via the fourth set of contacts and the second set of contacts to activate circuits on a printed circuit board on which the receptacle connector is mechanically and electrically mounted.

11. The apparatus as claimed in claim 8, wherein said receptacle connector is mechanically and electrically mounted on a printed circuit board, and said cable includes a braid layer electrically connected to grounding circuit on said printed circuit board.

12. An electrical system comprising:

a receptacle connector defining a cavity;

first and second sets of contacts provided around said cavity; and an antenna assembly and a plug connector selectively mutually exclusively assembled to said receptacle connector in said cavity, said antenna assembly and said plug connector defining a similar contour thereof in compliance with said cavity; wherein when the antenna assembly is installed into the cavity, the first set of contacts switches on wireless processing circuits, and the signals caught by the antenna assembly will be transmitted by said second set of contacts to activate said wireless processing circuits, while when the plug connector is installed into the cavity, the first set of contacts does not switch on the wireless processing circuits, and the signal from the plug will be transmitted by said second set of contacts to non-wireless processing circuits.

13. The system as claimed in claim 12, wherein said antenna assembly and said plug connector have different dimensions in either horizontal or vertical direction for differentiating activating the first set of contacts or not.

14. The system as claimed in claim 12, wherein said antenna assembly includes a forwardly and outwardly extending antenna portion, and a third set of contacts extending rearwardly and inwardly and electrically connected to said antenna portion.

15. The system as claimed in claim 14, wherein said third set of contacts mechanically and electrically engaged to said second set of contacts when said antenna assembly is installed in said cavity.

16. The system as claimed in claim 12, wherein a cable is electrically connected to said second set of contacts around a rear portion of the connector, constituting a part of said wireless processing circuits.

17. The system as claimed in claim 12, wherein said connector is mounted on a printed circuit board.

18. An antenna assembly for use with a receptacle connector which is adapted to use with a plug connector, comprising:

an insulative housing;

an antenna portion extending forwardly and outwardly from said housing; and a set of contacts extending rearwardly and outwardly from said housing and electrically connected to said antenna portion; wherein said insulative housing is dimensioned to be similar to said plug connector while with slightly different dimensions along either vertical or horizontal direction for differentiating activating wireless processing circuits electrically connected to said receptacle connector.

* * * * *